US007987620B2

(12) United States Patent
Huebner et al.

(10) Patent No.: US 7,987,620 B2
(45) Date of Patent: Aug. 2, 2011

(54) ROTARY UNDERCUTTER FOR RAIL LINE MAINTENANCE

(75) Inventors: David L. Huebner, Mound, MN (US); Aaron M. Foster, Robbinsdale, MN (US); John A. Dekarski, Delano, MN (US)

(73) Assignee: Loram Maintenance of Way, Inc., Hamel, MN (US)

( * ) Notice: Subject to any disclaimer, the term of this patent is extended or adjusted under 35 U.S.C. 154(b) by 0 days.

(21) Appl. No.: 12/961,113

(22) Filed: Dec. 6, 2010

(65) Prior Publication Data

US 2011/0072692 A1 Mar. 31, 2011

Related U.S. Application Data

(63) Continuation of application No. 12/535,425, filed on Aug. 4, 2009, now Pat. No. 7,845,098.

(60) Provisional application No. 61/180,673, filed on May 22, 2009.

(51) Int. Cl.
*E01B 27/00* (2006.01)

(52) U.S. Cl. ..... 37/104

(58) Field of Classification Search ..... 37/104–107; 171/16; 104/2, 7 R, 9; 299/31; 175/73, 175/76, 94

See application file for complete search history.

(56) References Cited

U.S. PATENT DOCUMENTS 3,967,395 A 7/1976 Stewart
3,967,396 A 7/1976 Maisonneuve et al.
4,042,035 A 8/1977 Boyer
4,119,154 A 10/1978 Miller
4,249,468 A 2/1981 Klaar
4,312,541 A * 1/1982 Spurgeon ..... 299/31
4,440,088 A 4/1984 Wallace et al.
4,563,826 A 1/1986 Whitaker, Jr.
4,707,935 A 11/1987 Cicin-Sain
4,713,898 A 12/1987 Bull et al.

(Continued)

FOREIGN PATENT DOCUMENTS

EP 1275781 A2 1/2003

(Continued)

OTHER PUBLICATIONS

PCT Search Report for Application No. PCT/US2009/052791, dated Jun. 22, 2009, 10 pages.

*Primary Examiner* — Robert Pezzuto
(74) *Attorney, Agent, or Firm* — Patterson Thuente Christensen Pedersen, P.A.

(57) ABSTRACT

A railroad ballast removal system capable of removing ballast material from below a rail line. The railroad ballast removal system includes at least one rotary cutting wheel having a plurality of individually replaceable cutting attachments positioned about a perimeter of the rotary cutting wheel. Each rotary cutting wheel is attached to an articulated arm capable of adjusting the position of the rotary cutting wheel along varying axis. The articulated arm is mounted to a support structure capable of transporting the rotary cutting wheel to a portion of railway requiring maintenance of the ballast material. The railroad ballast removal system is able to operate at a spot location or in a continuous manner down a length of railroad track. The ability to manipulate the rotary cutting wheel along the various axis allows the rotary cutting wheel to be used for ballast removal in locations wherein adjacent railways limit cutting access.

10 Claims, 14 Drawing Sheets

U.S. PATENT DOCUMENTS

| | | | | |
|---|---|---|---|---|
| 4,720,929 | A * | 1/1988 | Umberson | 37/91 |
| 4,850,123 | A | 7/1989 | Whitaker, Jr. | |
| 4,858,344 | A | 8/1989 | Cotsford | |
| 5,101,733 | A | 4/1992 | Mohr | |
| 5,172,638 | A | 12/1992 | Mathison et al. | |
| 5,201,127 | A | 4/1993 | Whitaker, Jr. | |
| 5,284,097 | A | 2/1994 | Peppin et al. | |
| 5,347,933 | A | 9/1994 | Mathison et al. | |
| 5,417,165 | A | 5/1995 | Peppin et al. | |
| 6,782,955 | B2 | 8/2004 | Theurer et al. | |
| 6,862,822 | B1 | 3/2005 | Masse | |
| 6,978,718 | B2 | 12/2005 | Seyrlehner | |
| 2003/0159316 | A1 | 8/2003 | Allen | |
| 2005/0155257 | A1 | 7/2005 | Pike et al. | |
| 2005/0229440 | A1 | 10/2005 | Arzberger | |

FOREIGN PATENT DOCUMENTS

| | | | |
|---|---|---|---|
| EP | 1275781 | A3 | 1/2004 |
| EP | 1650347 | A1 | 4/2006 |
| JP | 62-099502 | A | 10/1994 |
| KR | 9308237 | Y1 | 12/1993 |
| WO | WO 96/06979 | | 3/1996 |

* cited by examiner 100
102
112
112
116
116

110
102
112
112
104
104
116
116
222

ROTARY UNDERCUTTER FOR RAIL LINE MAINTENANCE

PRIORITY CLAIM

This application is a continuation of application Ser. No. 12/535,425 filed Aug. 4, 2009, which claims the benefit of U.S. Provisional Application No. 61/180,673 filed May 22, 2009, each which is herein incorporated by reference in its entirety.

FIELD OF THE INVENTION

The present invention relates generally to railroad maintenance systems. More specifically, the present invention is directed to a rotary undercutting system for use in removing ballast material from below a railroad track.

BACKGROUND OF THE INVENTION

The maintenance of railroad track ballast is an ongoing and important element of railroad transportation safety. The ballast material associated with railroad track lines, typically crushed rock or gravel, helps to provide horizontal and vertical support to the railroad line and also provides a drainage mechanism to help remove damaging moisture away from the railroad track and ties. Periodically, the ballast along a length of track, or in single spot locations, may become fouled with dirt, oil, debris, or other matter that can reduce the draining properties or supporting ability of the ballast. Therefore, railroad operators must periodically replace or recondition this fouled ballast in order to maintain the integrity and safety of the railroad line. The repair of rail line ballast is not easily accomplished with traditional earth-moving equipment. The rail and tie configuration of railroad lines requires the use of specialized equipment if the rail and tie assembly is to remain in place during reconditioning. Because of the time and cost involved in removing and constructing railroad lines, it is highly desirable to leave the rail line in place during reconditioning and to minimize or eliminate the time when the line is unavailable for rail traffic.

Currently in the marketplace, there are a variety of machines and techniques for removing railroad track ballast. For example, one approach is to remove a short section of track ballast and insert a plow or sled towed by a specially equipped railcar to push or force the ballast to the outside edges of the track. A second example of a ballast removing device is a "chainsaw" type mechanism where a long blade supports a rotating chain or belt that can be manipulated to "cut" ballast out from underneath the rails and ties of an existing track. Representative prior art maintenance and removal systems for railroad ballast include U.S. Pat. Nos. 3,967,396, 4,119,154, 4,858,344, and 6,862,822, each of which is herein incorporated by reference.

Generally, the plow or sled approach for removing ballast is limited to situations where a long stretch of track is to be reconditioned due to the fact that the effort required to initially place the plow under the rail line is not typically justifiable for short segments of track. While the chain equipped ballast cutter may be more suitable for short distance ballast removal it can be subject to chain or belt breakage requiring maintenance to replace or repair of the cutting assembly. Thus, neither of these existing technologies satisfies the need for a ballast removing apparatus capable of being reliably and cost effectively used for both short and long distance ballast removal.

In certain track layout configurations it is also inconvenient to use either the ballast plow or a large chain driven cutting apparatus. For example, in areas such as rail yards, sidings, and other locations where multiple lines run in parallel to each other in close proximity it can be difficult to maneuver a large cutting machine into position between the rail lines or there may be inadequate space on either side of the railroad line to deposit the fouled ballast as it is removed from underneath the rails.

Therefore, an unsolved need exists for further improvement to existing railroad ballast removing systems. The system should be able to quickly and effectively remove ballast from underneath existing rail lines and to provide an easily maneuverable cutting or cutting apparatus that is capable of operating in restricted areas. Additionally, the system should be configured such that the risk of breakage is minimized and such that it is easily maintained or serviced when necessary. By eliminating the use of a belt or chain assembly maintenance time and cost can be reduced, further reducing costs associated with rail line maintenance and reconditioning.

SUMMARY OF THE INVENTION

In order to address the needs described above, a representative ballast-removal system according to the present invention comprises a pair of rotating cutters attached to a rail platform or alternatively, a stand-alone vehicle, by a pair of multi jointed arms or boom assemblies capable of positioning the cutters as needed. The ballast removal system of the present invention involves fewer parts than existing ballast cutting systems, thereby reducing downtime associated with part replacement while providing a greater degree of flexibility in positioning the cutters. The ballast removal system described here is capable of being installed to work with existing ballast reconditioning systems where multiple machines are connected in order to remove, filter, and replace fouled ballast.

In one aspect, the present invention is directed to a rotary cutting head that is attached to an articulatable mechanical arm or manipulator for ease of positioning and excavation of railroad track ballast. The rotary cutting head can comprise a plurality of individually replaceable cutting elements.

In another aspect, the present invention is directed to a method of removing railway ballast material. A first step can comprise providing one or more of a rotary cutting head attached to an articulatable mechanical arm. A second step can comprise manipulating the rotary cutting head with the articulatable mechanical arm to cut into the railway ballast. A third step can comprise operating the at least one rotary cutting head below the railway to remove the railway ballast. In one preferred method of removing railway ballast material, a pair of rotary cutting heads, each being provided on its own articulatable mechanical arm, are provided to operate below the railway for removing the railway ballast material.

In another aspect, the present invention is directed to a system comprising a pair of rotary cutting heads mounted together such that the two heads are oriented towards each other when excavating material.

In yet another aspect, the present invention is directed to a railroad ballast removal system including a pair of rotary ballast removing cutters, the cutters mounted on a pair of multi-axis mounting arms capable of movement with multiple degrees of freedom. The mounting arms can be removably attached to a specialized railcar or other mobile vehicle for use in clearing material to facilitate railroad line maintenance or construction.

In yet another aspect, the present invention is directed to a method of reducing an amount of space necessary to cut into a rail bed for removing ballast material. In some embodiments, the method can be practiced in railyards or other locations having at least a pair of railways located in proximity.

The above summary of the invention is not intended to describe each illustrated embodiment or every implementation of the present invention. The figures and the detailed description that follow more particularly exemplify these embodiments.

BRIEF DESCRIPTION OF THE DRAWINGS

The present invention is more completely understood in consideration of the following detailed description of various embodiments in connection with the accompanying drawings, in which.

Figure 1:
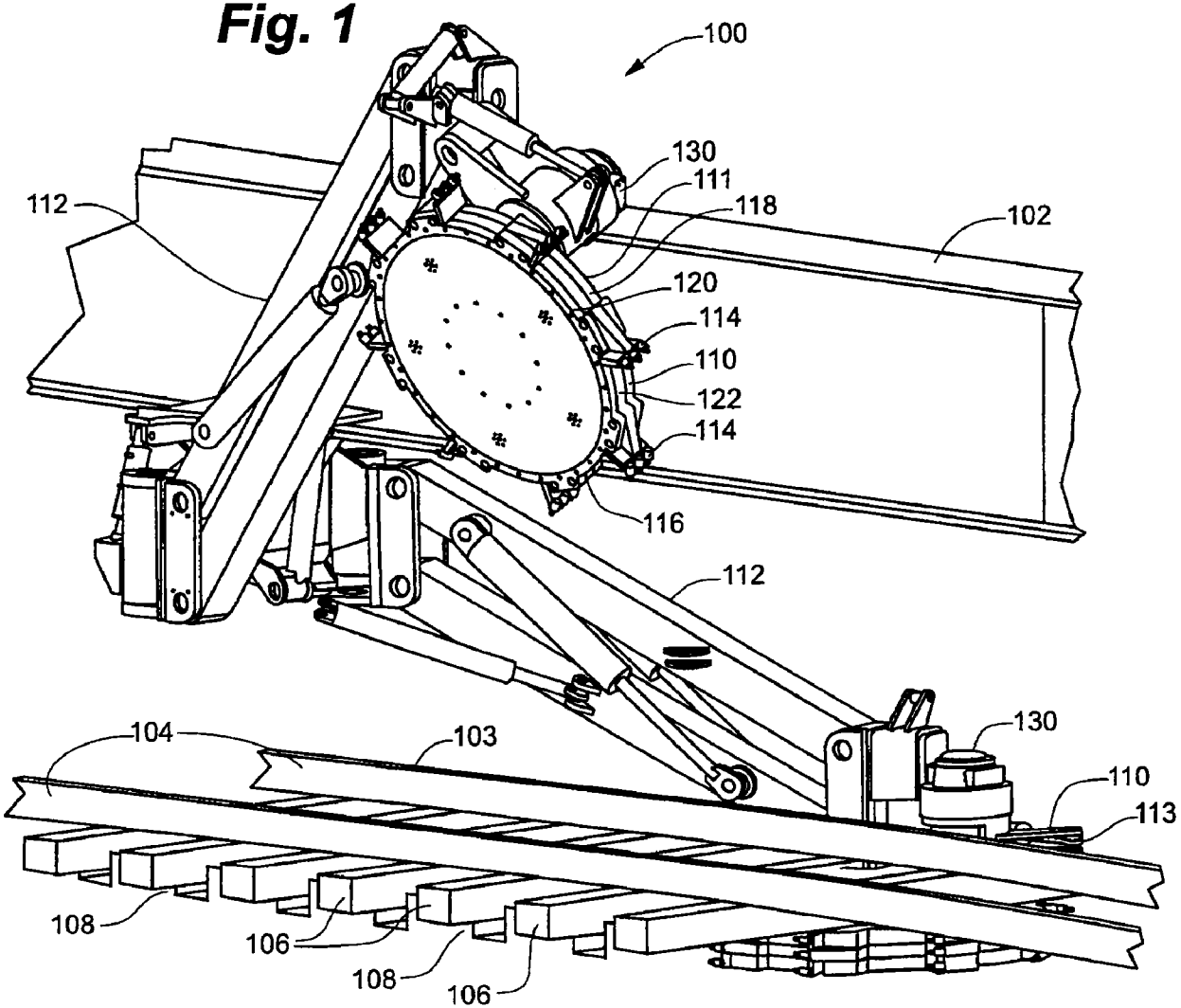
FIG. 1 is a front, perspective view of a rotary undercutter according to an embodiment of the present invention.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention as defined by the appended claims.

DETAILED DESCRIPTION OF THE INVENTION

As shown in FIG. 1, a representative embodiment of a rotary undercutter 100 is shown mounted to a support structure 102 suspended between two railcar carriages (not depicted). The rotary undercutter 100 is suspended above a rail line 103 including pair of rails 104 and rail ties 106 that have been lifted above their ballast 108. As shown in FIG. 1, rotary undercutter 100 can include a pair of cutting wheel assemblies 110 with one shown disposed in an elevated position 111 while the other is shown in an operating position 113 below the rails 104. Each cutting wheel assembly 110 is individually manipulated and positioned by a corresponding multi jointed positioning arm 112. The positioning arms 112 can include a non-limiting variety of hinges, couplings, joints, sliding mechanisms, actuators, hydraulics, motors, or the like, as needed to mount the cutting wheel assemblies 110 to support structure 102 or alternatively, directly to a vehicle and to allow the cutting wheel assemblies 100 to be oriented and positioned during use or transport. As illustrated throughout the figures, a pair of positioning arms 112 are generally illustrated in a substantially inline arrangement with respect to the support structure 102. It will be understood, that in certain ballast maintenance arrangements, positioning arms 112 can be off-set or otherwise staggered along the support structure 102 to allow for cutting overlap to ensure complete cutting and ballast removal below the rails 104. In some embodiments, support structure 102 can comprise a rail car intended solely for the removal of ballast 108 while in other alternative embodiments, support structure 102 can comprise a car configured with additional systems for cleaning and replacing ballast 108.

Figure 2:
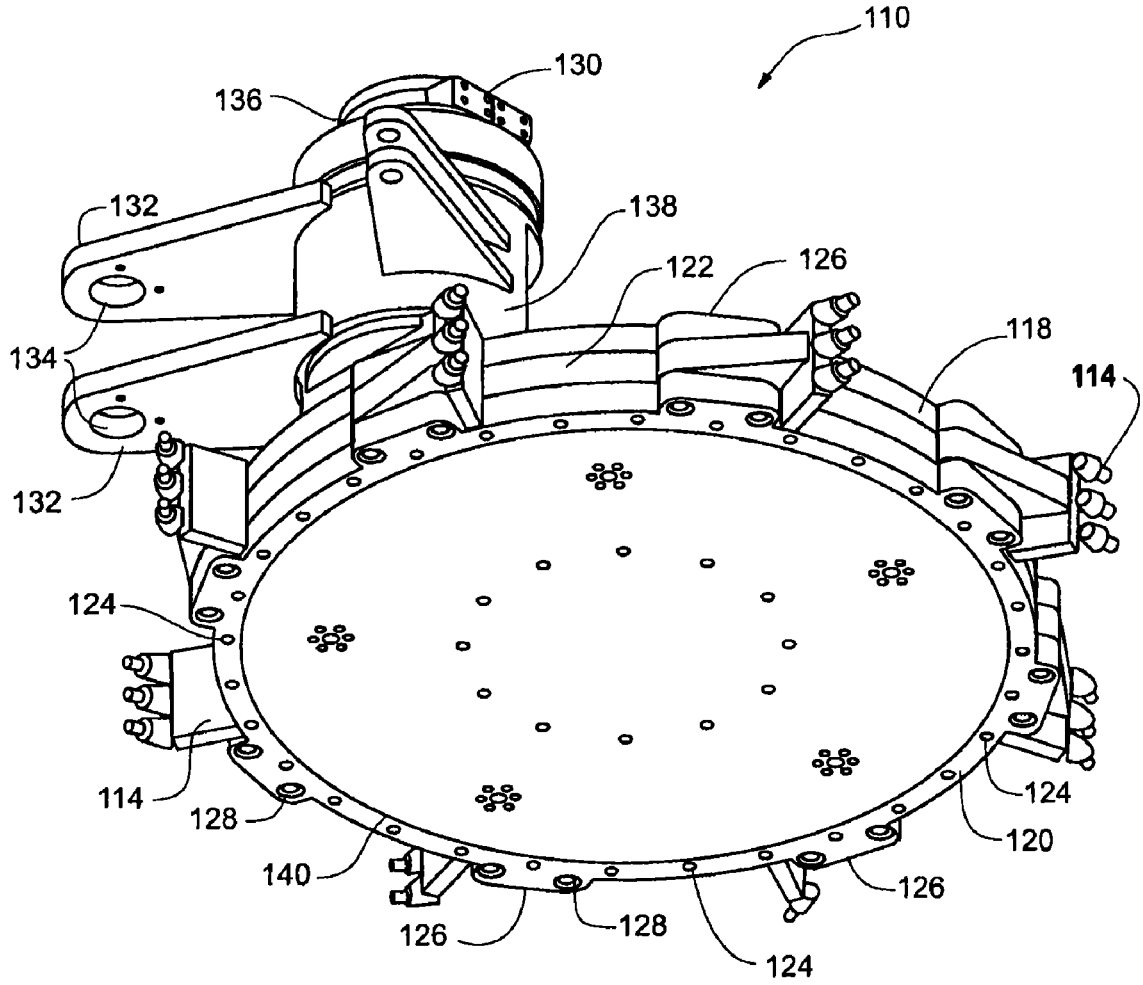
FIG. 2 is a bottom, perspective view of a rotary cutting wheel assembly according to a representative embodiment of the invention.
Figure 3:
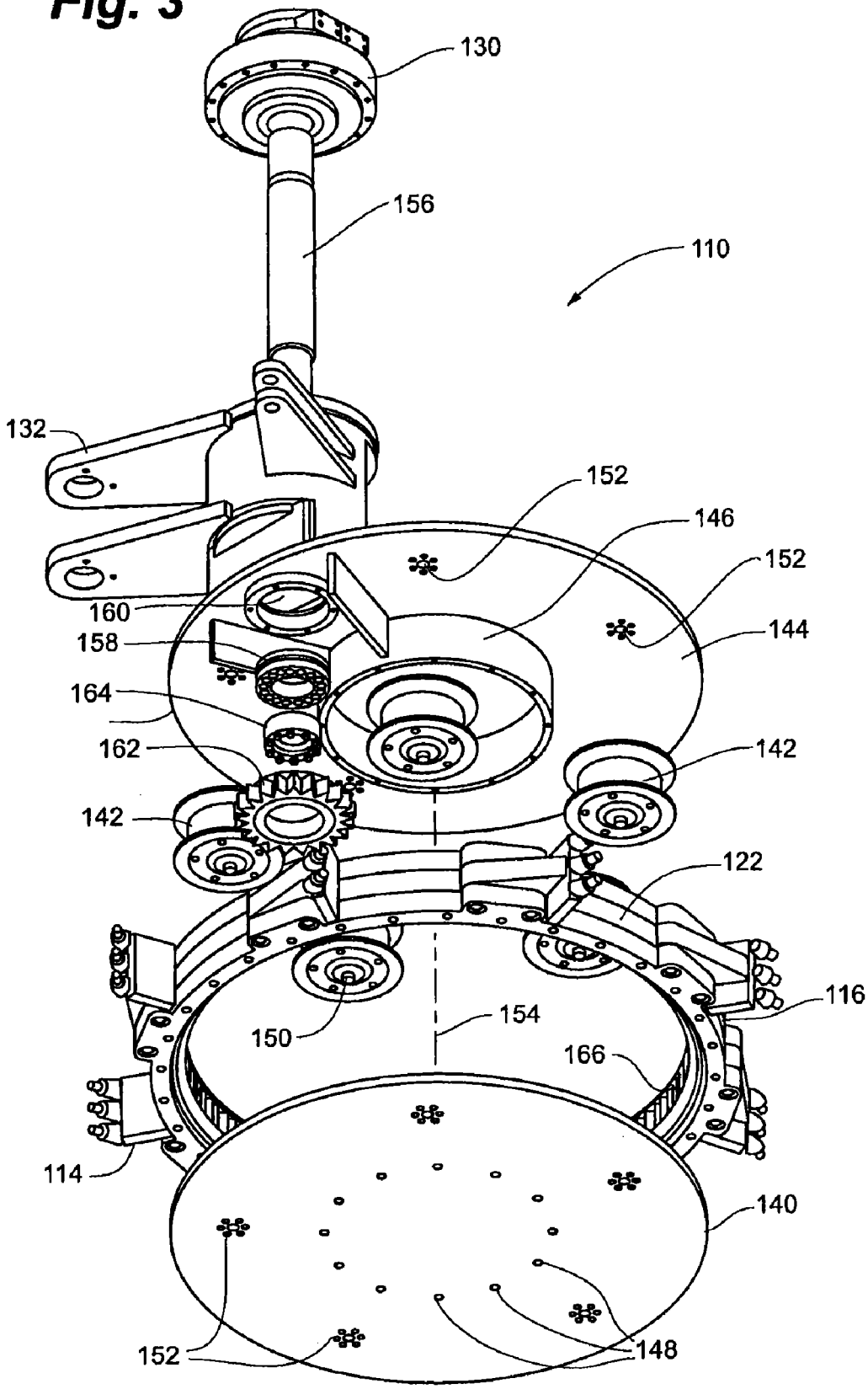
FIG. 3 is an exploded, bottom perspective view of the rotary cutting wheel assembly of FIG. 2.

As seen in FIGS. 2 and 3, the present embodiment of cutting wheel assembly 110 comprises a plurality of cutting attachments 114 mounted at the periphery or perimeter rim of a rotating cutting wheel 116. Each cutting attachment 114 is individually, removably attached to the rotating cutting wheel 116 in order to facilitate the replacement of individual cutting attachments 114 in the event of breakage or excessive wear. The cutting attachment 114 can comprise a tooth configuration, or alternatively, configurations such as, for example, shovels, paddles, and the like are contemplated. It is envisioned that the number of individual cutting attachments 114, and the corresponding space between them around the perimeter of the rotating cutting wheel 116, can be varied depending on the diameter of the rotating cutting wheel 116, the consistency of the support ballast 108 that is to be removed and desired speeds of rotation and advancement of the rotary undercutter 100 along the rail line 103.

Cutting wheel assembly 110 generally comprises a plurality of rings including an upper ring 118, a lower ring 120 and a central drive ring 122. The upper ring 118 and the lower ring 120 are layered on the central drive ring 122 and coupled together with fasteners 124 passing through the central drive ring 122. The upper ring 118 and the lower ring 120 can provide attachment points 126 for the cutting attachments 114. The cutting attachments 114 can be removably fastened to the upper ring 118 and the lower ring 120 with threaded bolt fasteners 128 or any other appropriate fastening mechanisms.

The cutting wheel assembly 110 also includes a drive motor 130 located on the top side of the cutting wheel assembly 110. A mounting bracket 132 having mounting points 220, along with an actuation bracket 136 are attached to a drive column 138 that can provide support for the drive motor 130. The drive column 138 is offset from the center of the cutting wheel assembly 110 and is generally located near the perimeter of the cutting wheel assembly 110 such that a majority of the cutting wheel assembly 110 can be positioned under the rail 104. By eliminating any interference with the drive column 138 and rail 104, the overall size of the cutting wheel assembly 110 necessary to clear a given area of ballast 108 can be reduced.

Support and drive mechanisms for cutting wheel assembly 110 are generally illustrated in FIG. 3. A lower disk 140 provides a plurality of mounting points for bogey wheels 142 that are located inside the upper ring 118, lower ring 120 and central drive ring 122 forming the cutting wheel assembly 110. The bogey wheels 142 can support and stabilize cutting wheel assembly 110 and provide structural rigidity to an upper disk 144 and the lower disk 140. The lower disk 140 can be connected to the upper disk 144 by a central hub 146 at a plurality of securement points 148 as well as by the axels 150 of the bogey wheels 142. The axels 150 of the bogey wheels 142 are secured to the lower disk 140 and the upper disk 144 at fixed locations 152, providing a uniform guide for the cutting wheel assembly 110 to travel about a central axis 154.

Drive motor 130 is coupled to a drive shaft 156 in order to provide rotational torque to the cutting wheel assembly 110. The drive shaft 156 is supported in the drive column 138 by bearing assembly 158 located in lower opening 160 of the upper disk 144. The drive shaft 156 is coupled to a drive gear 162 by bushing 164. The drive gear 162 interfaces with the internal gear 166 that can be disposed on or formed by the central drive ring 122. Drive motor 130 can be driven by a generator that is operably positioned on support structure 102.

Figure 4:
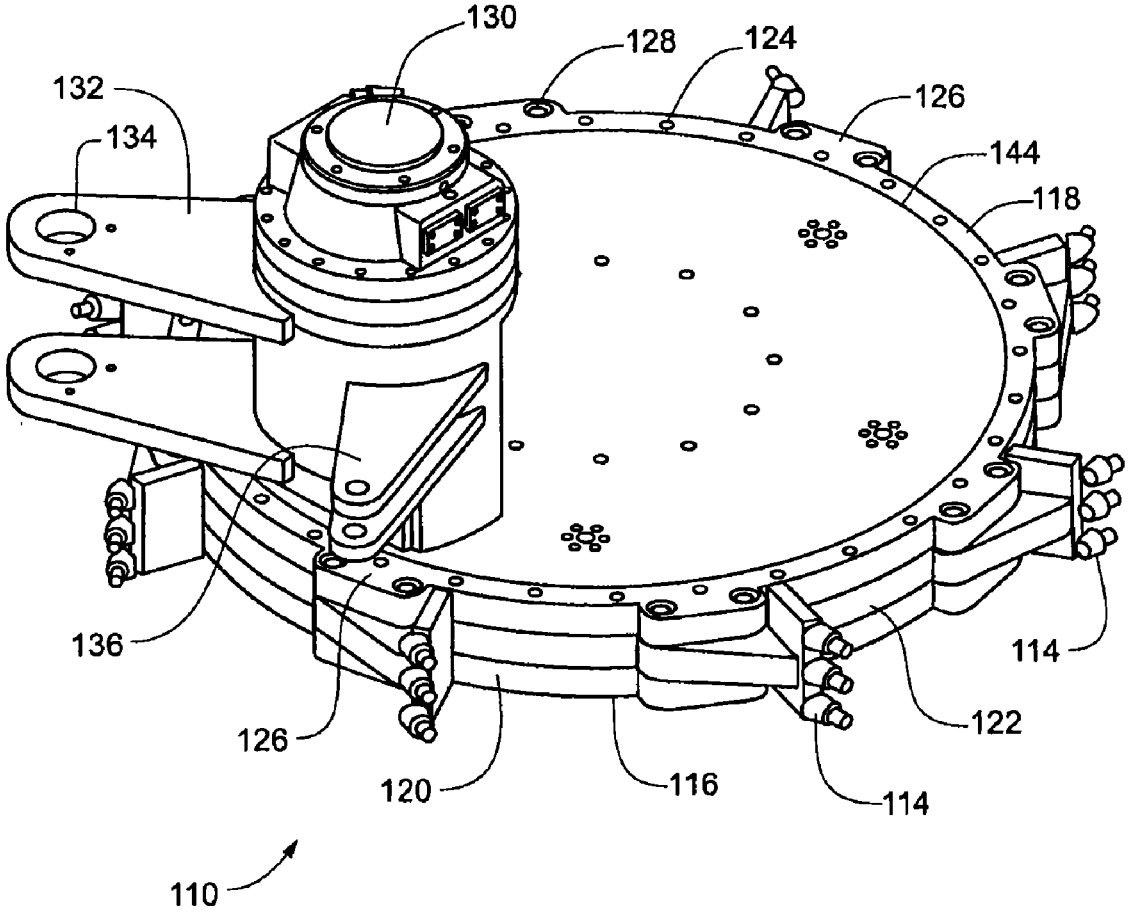
FIG. 4 is an upper perspective view of the rotary cutting wheel assembly of FIG. 2.
Figure 5:
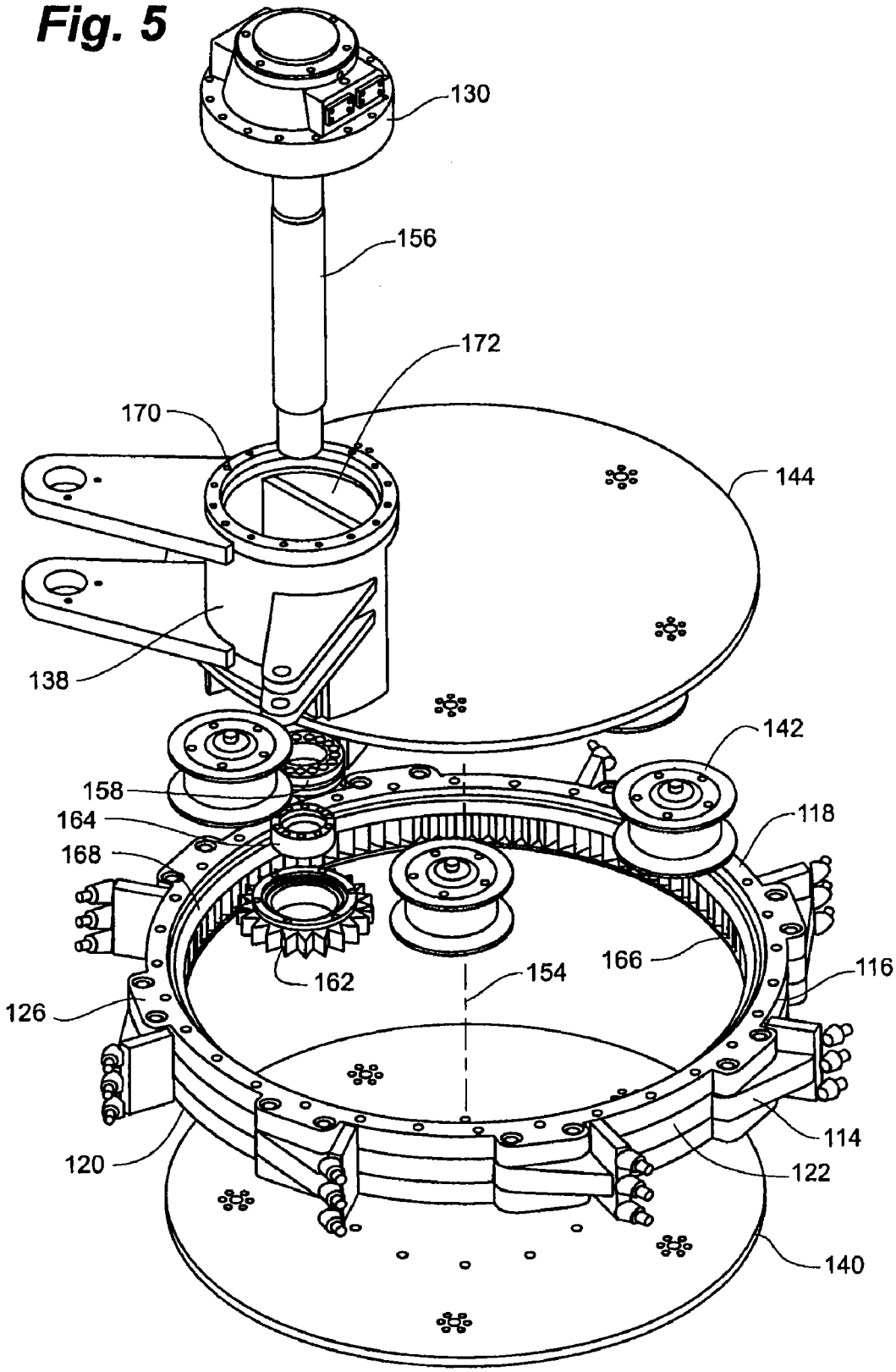
FIG. 5 is an exploded, top perspective view of the rotary cutting wheel assembly of FIG. 2.

Referring now to FIGS. 4 and 5, a top view of the cutting wheel assembly 110 is depicted. The upper disk 144 can be located inside an interior lip 168 of the upper ring 118 such that the rotary cutting wheel 116 can ride along the perimeter of the upper disk 144. Likewise, the lower ring 120 can ride along the perimeter of the lower disk 140. Interior lip 168 can be formed in the material comprising the upper and lower rings 118, 120 or alternatively the central drive ring 122 can have a greater thickness than the upper ring 118 and the lower ring 120. This can be embodied in a central drive ring 122 with a smaller internal diameter than the internal diameter of the upper ring 118 and the lower ring 120. As shown in this example embodiment, the outer diameter of the central drive ring 122, the upper ring 118 and the lower ring 120 are generally equal, with the exception of the areas in the upper ring 118 and the lower ring 120 that form the attachment points 126 for the cutting attachments 114.

The drive gear 162 is depicted in FIG. 5 as meshing with the internal gear 166. As previously discussed, the bushing 164 and bearing assembly 158 allow the coupling of the drive motor 130 to the drive gear 162 through the drive shaft 156. The drive column 138 in this embodiment is not wholly circular. Below an upper opening 170 that provides a mounting point for the drive motor 130 is a generally flat face 172 directed toward the central axis 154 of the cutting wheel assembly 110. While the drive column 138 must provide sufficient clearance for the location of the drive shaft 156 between the motor 130 and the drive gear 162, the flat face 172 can help to provide a greater operating range for the cutting wheel assembly 110 as the flat face 172 can pass along the edge of the rail ties 106 at a minimum distance.

Figure 6:
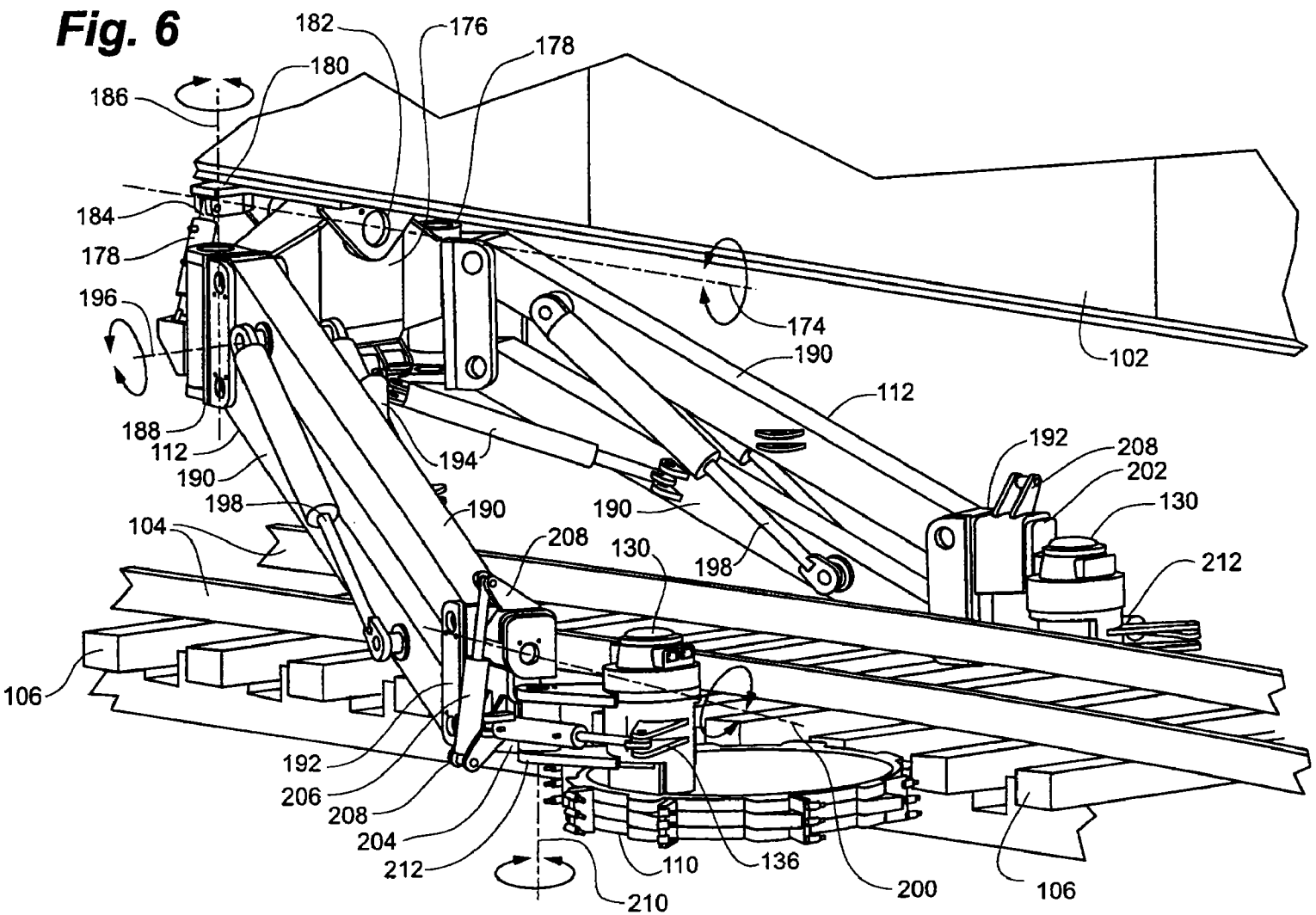
FIG. 6 is a front, perspective view of the rotary undercutter of FIG. 1 where both rotary cutting wheels are positioned under an existing rail line.
Figure 7:
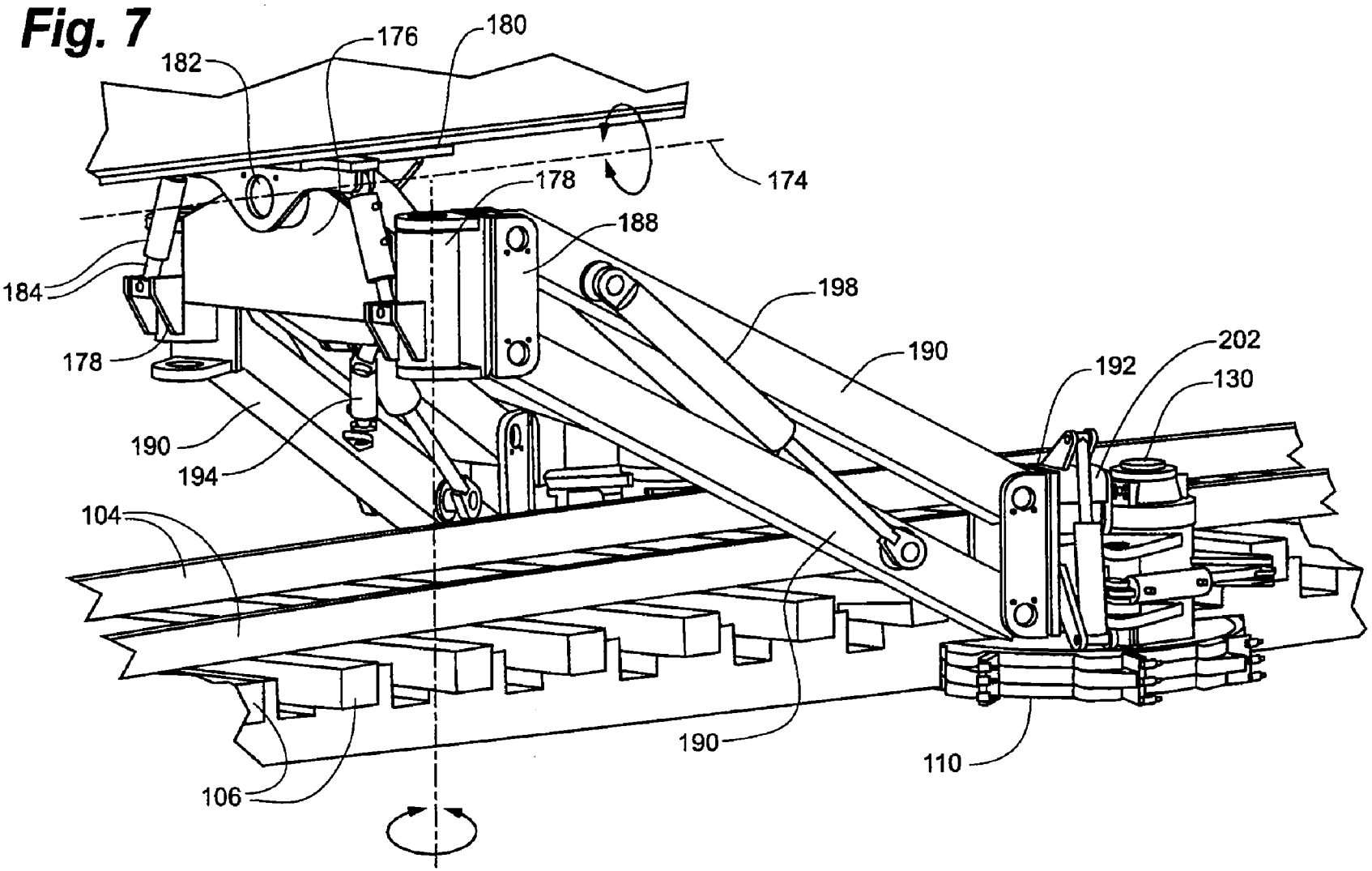
FIG. 7 is a rear, perspective view of the rotary undercutter of FIG. 6.

FIGS. 6 and 7 depict an exemplary embodiment of positioning arms 112 that can be used to connect the cutting wheel assemblies 110 to support structure 102, or other appropriate support structures positioned over a set of rails 104. The use of the multi-jointed positioning arm 112 enables the actuation of the cutting wheel assemblies 110 about a plurality of axis. In the example embodiment the cutting wheel assemblies 110 can be adjusted for roll, pitch, yaw, and horizontal or vertical positioning. In this example embodiment depicted there are five unique axis of movement defined by the plurality of supports and actuators and will be discussed numerically.

A first rotational axis 174 can be provided by a carriage 176 that can provide a mounting point 178 for each of the pair of positioning arms 112. The carriage 176 can pivot or roll about the first rotational axis 174 when mounted to an attaching bracket 180. In addition, the carriage can adjust both positioning arms 112 for cross-level cutting as may be appropriate and necessary for super-elevated curves. The attaching bracket 180 can comprise a central shaft 182 or other appropriate structure for providing first rotational axis 174 parallel to the path of rails 104. The carriage 176 can be rotated about first rotational axis 174 by a pair of first-axis actuators 184 that can be located at the edges of carriage 176 and attaching bracket 180. The first-axis actuators 184, and any of the other actuators to be discussed below, can be driven by hydraulic pressure, or other appropriate force such as pneumatics, through a plurality of hoses or control lines, not depicted here for clarity. As understood by those skilled in the art, the placement of the hoses or control lines necessary to operate the rotary undercutter 100 is an important consideration, but not critical to the overall design of the present invention.

A second rotational axis 186 providing horizontal movement for each positioning positioning arm 112 is located at the interface of the mounting point 178 of the carriage 176 and a shoulder coupler 188 that rotatably joins one end of a pair of primary beams 190 together. At an opposite end of each of the pair of primary beams 190, the cutting wheel assembly 110 is rotatably joined to the cutting wheel assembly 110 with a wrist coupler 192. The second rotational axis 186 provides for one or both of the cutting wheel assemblies 110 to be moved towards or away from a central line between the rails 104 allowing movement for initial positioning of the cutting wheel assemblies 110, during the operation of the rotary undercutting system 100 to remove ballast 108, or for extraction of the cutting wheel assemblies 110 at the completion of a task. In addition, the second rotational axis 186 allows the cutting wheel assemblies 110 to be shifted to accommodate cutting at railway curves where rails 104 shift, in some situations by an amount of up to 2 feet, relative to the support structure 102. A pair of second axis actuators 194 can be attached to an interior surface of each primary beam 190 to provide horizontal movement.

A third rotational axis 196 providing vertical positioning of the cutting wheel assemblies 110 can be achieved by manipulating the pair of primary beams 190 with a set of vertical manipulators 198. As shown in FIGS. 6 and 7 the vertical manipulators 198 can be positioned on the interior and exterior surfaces of the primary beams 190. While the example embodiment depicted here utilizes a pair of primary beams 190, alternative configurations are contemplated where only a single primary beam in conjunction with an appropriately configured manipulator or manipulators can accomplish the vertical positioning of the cutting wheel assemblies 110.

A fourth rotational axis 200 at the wrist coupler 192 provides independent roll adjustment of each of the cutting wheel assemblies 110. A top housing 202 can be connected to the wrist coupler 192, and forms the fourth rotational axis 200 at the interface between the top housing 202 and a lower housing 204. A fourth axis actuator 206 can be removably connected to the top housing 202 and the lower housing 204 with a plurality of mounting brackets 208.

The independent control of the roll position of each of the individual cutting wheel assemblies 110 is advantageous for the removal of ballast 108 from sections of rail line 103 where one rail 104 is located vertically, or superelevated, above the other rail 104, such as in a banked turn or curve. The combination of the independent vertical positioning of the primary beams 190 and the fourth rotational axis 200 at the wrist coupler 192 provide an operator of the rotary undercutter 100 to remove only the appropriate ballast 108 from each side of the rail line 103. This combination also helps the operator of the rotary undercutter 100 avoid potentially damaging contact between the cutting wheel assemblies 110 and the rail ties 106.

A fifth rotational axis 210 provides independent yaw adjustment of the cutting wheel assemblies 110. A yaw actuator 212 connecting the lower housing 204 and the actuation bracket 136 provides for the yaw or horizontal positioning of the cutting wheel assemblies 110. This horizontal positioning can be used to adjust the depth of the cut into the ballast 108 during the operation of the rotating cutting wheel assemblies 110. The cutting wheel assemblies 110 on each side of the rotary undercutter 100 can be adjusted independently of the other, and can be positioned such that they nearly contact each other when centered underneath a set of rails 104 for effective removal of the ballast 108. In addition, fifth rotational axis 210 increases safety and mechanical reliability by essentially allowing the cutting wheel assemblies 110 to function as a mechanical fuse, whereby the cutting wheel assemblies 110 can swing outward from rails 104 if hazards or other obstacles such as, for example, buried ties, tie plates or old rails, are encountered.

Figure 8:
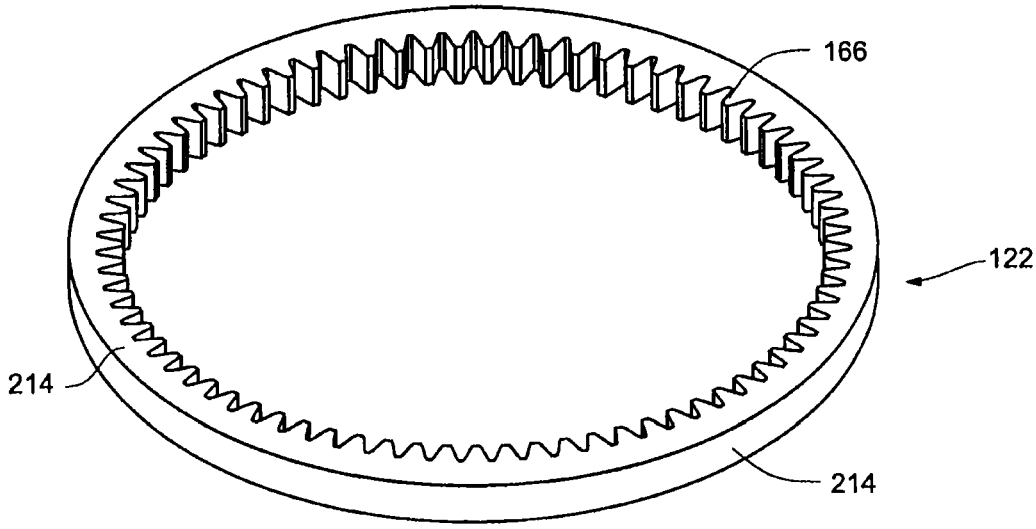
FIG. 8 is a top, perspective view of a pair of internal gear components of the rotary cutting wheel assembly of FIG. 2.

FIG. 8 depicts two unassembled examples of the central drive ring 122 configured to form the internal gear 166. Flat portions 214 on the outer perimeter of the central drive ring 122 can provide a contact point for cutting attachments 114.

Figure 9:
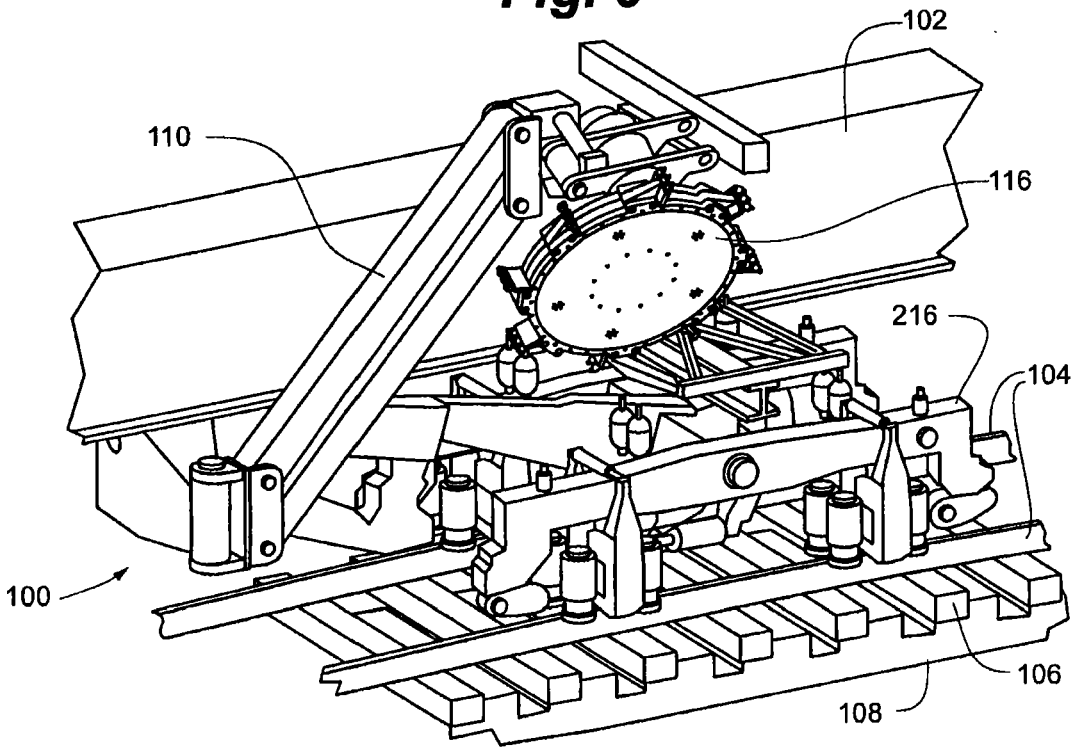
FIG. 9 is a rear, perspective view of a rotary undercutter of the present invention configured in conjunction with a track lifter assembly.

FIG. 9 depicts one embodiment of the rotary undercutter 100 along with a rail track lifter 216 mounted to the support structure 102. This configuration of equipment facilitates the efficient removal of ballast 108 from underneath rails 104.

Figure 10:
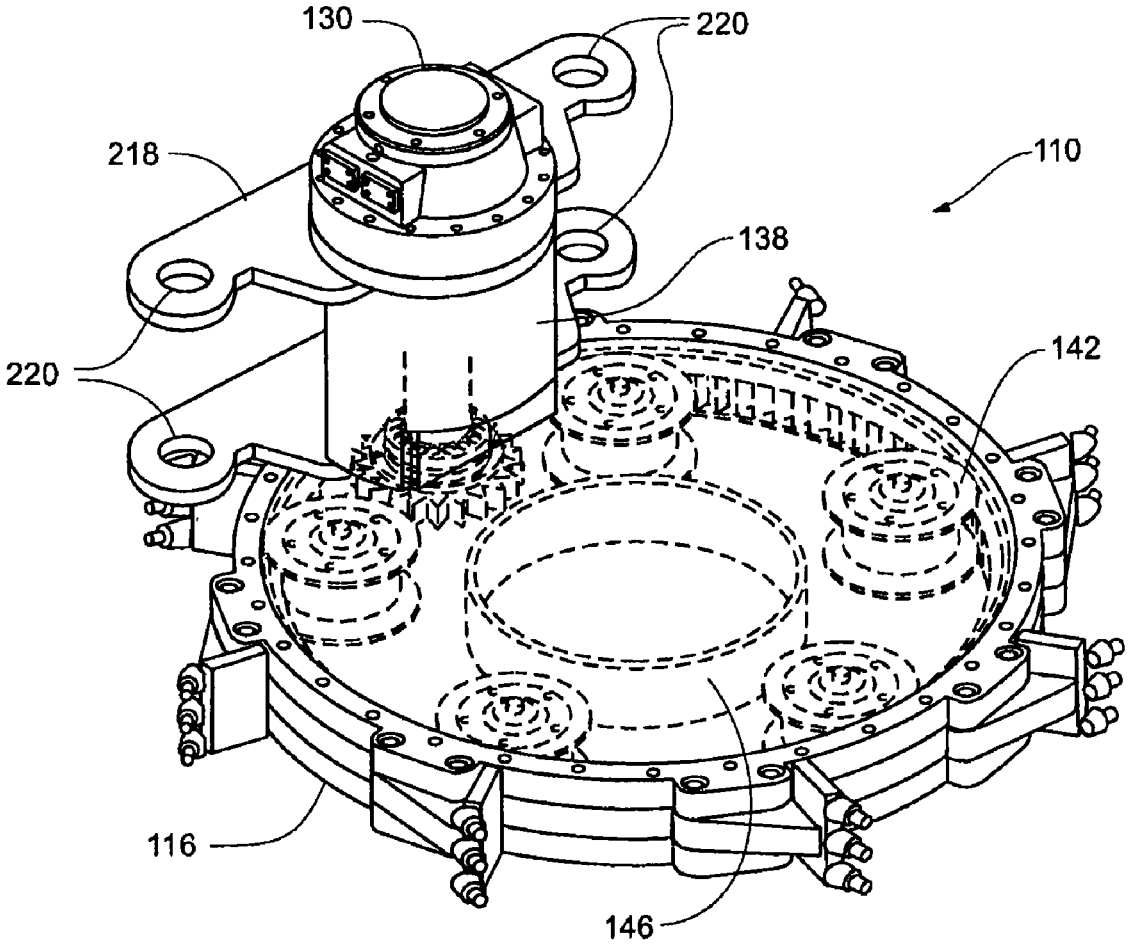
FIG. 10 is a top, perspective view of an internal assembly of the rotary cutting wheel assembly of FIG. 2.

FIG. 10 depicts another embodiment of a cutting wheel assembly 110 showing the positioning of the bogey wheels 142 relative to the central hub 146 and the rotary cutting wheel 116. In the place of the mounting bracket 132 as described previously, the illustrated embodiment depicts a reversible mount 218 that allows for a single cutting wheel assembly 110 to be mounted to either the right or left side of the rotary undercutter 100. The reversible mount 218 includes a pair of mounting points 220 on either side of the drive column 138.

Figure 11A:
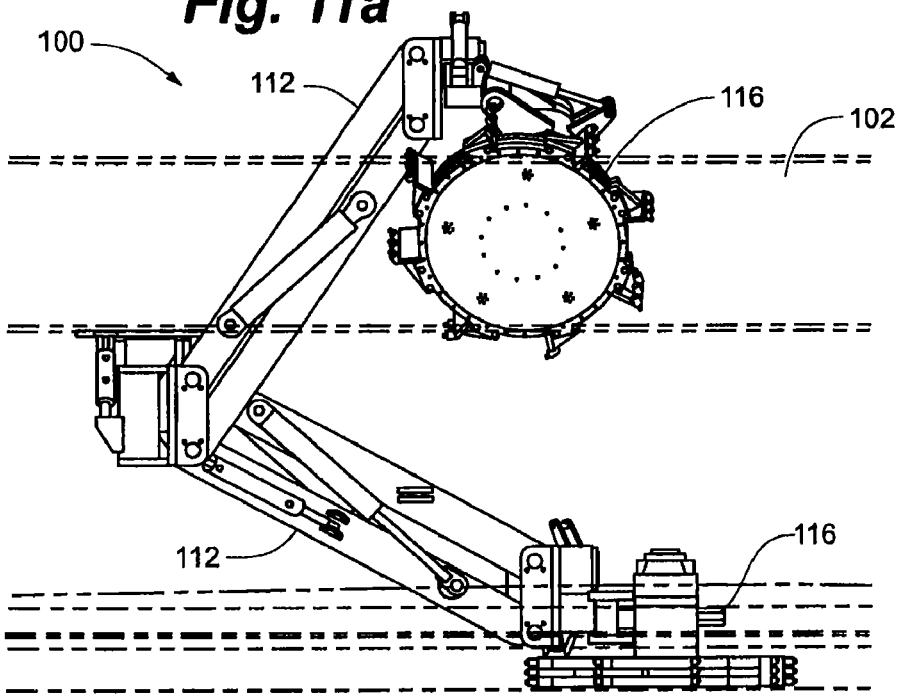
FIG. 11*a* is a side view of the rotary undercutter of FIG. 1 operating on a track with an adjacent rail line.
Figure 11B:
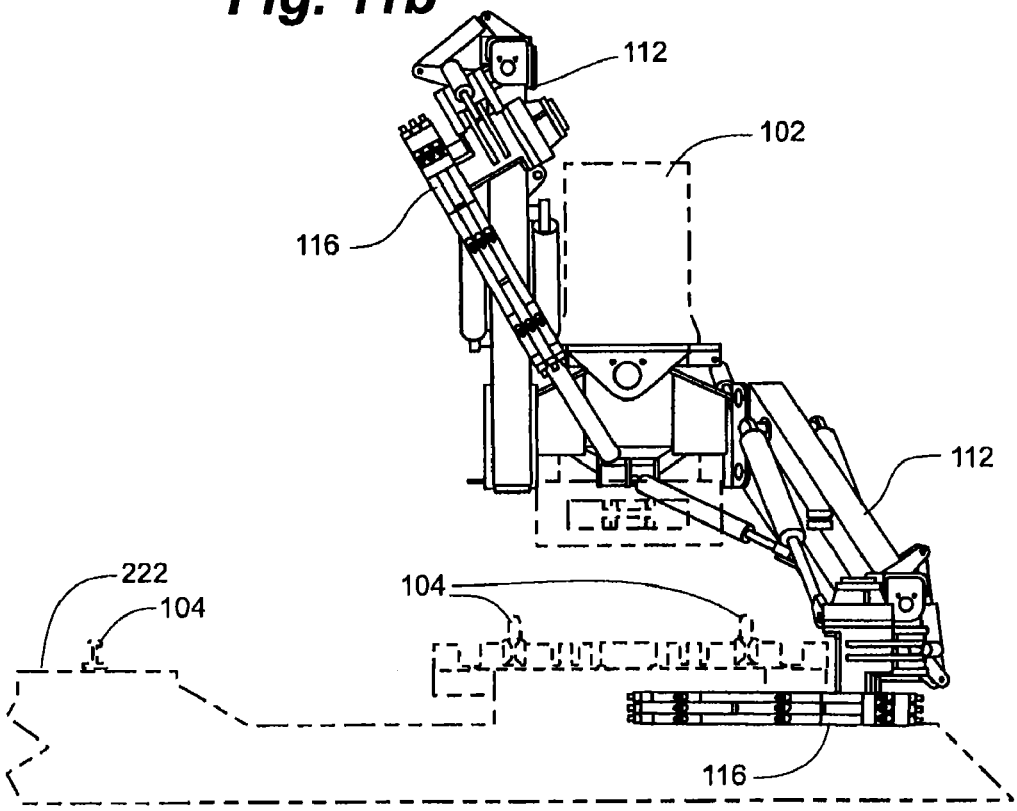
FIG. 11*b* is a front view of the rotary undercutter of FIG. 11*a*.

FIGS. 11*a* and 11*b* depict an embodiment of a rotary undercutter system 100 positioned on rails 104 where a parallel track 222 runs adjacent to the rail 104. This configuration of parallel rail lines is often encountered in rail sidings, switching yards and double or multiple track locations. As depicted in FIG. 11*b*, the multi jointed positioning arm 112 closest to the parallel track 222 is suspended above the rail 104 such that the undercutter system 100 requires no more than the physical space of a typical rail car such that the undercutter system 100 is able to pass by a set of railcars (not depicted) on the parallel track 222 without contacting the railcars on the parallel track 222.

Figures 12A, 12B:
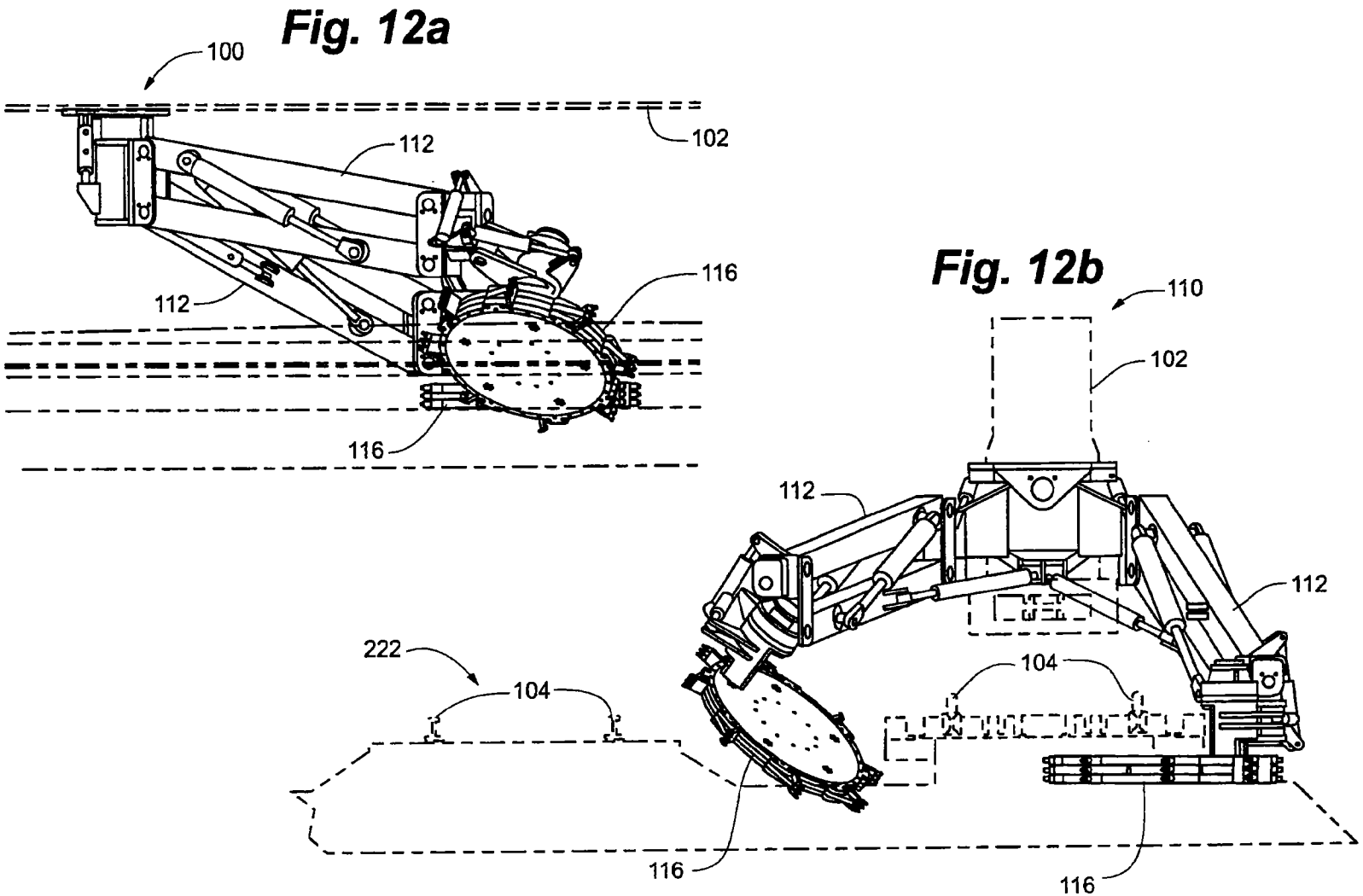
FIG. 12*a* is a side view of the rotary undercutter of FIG. 1 cutting under a track with an adjacent rail line.
FIG. 12*b* is a front view of the rotary undercutter of FIG. 12*a*.

FIGS. 12*a* and 12*b* depict an embodiment of a rotary undercutter system 100 where the multi-jointed positioning arm 112 closest to the parallel track 222 is guiding the cutting wheel assembly 110 to cut into the ballast 108 under the rail 104. This process is accomplished without interfering with the parallel track 222. Unlike existing systems, the rotary undercutter system 100 of this embodiment is configured to remove ballast 108 with minimal disruption to any parallel track 222 located on either side of the rotary undercutter system 100.

Figures 13A, 13B:
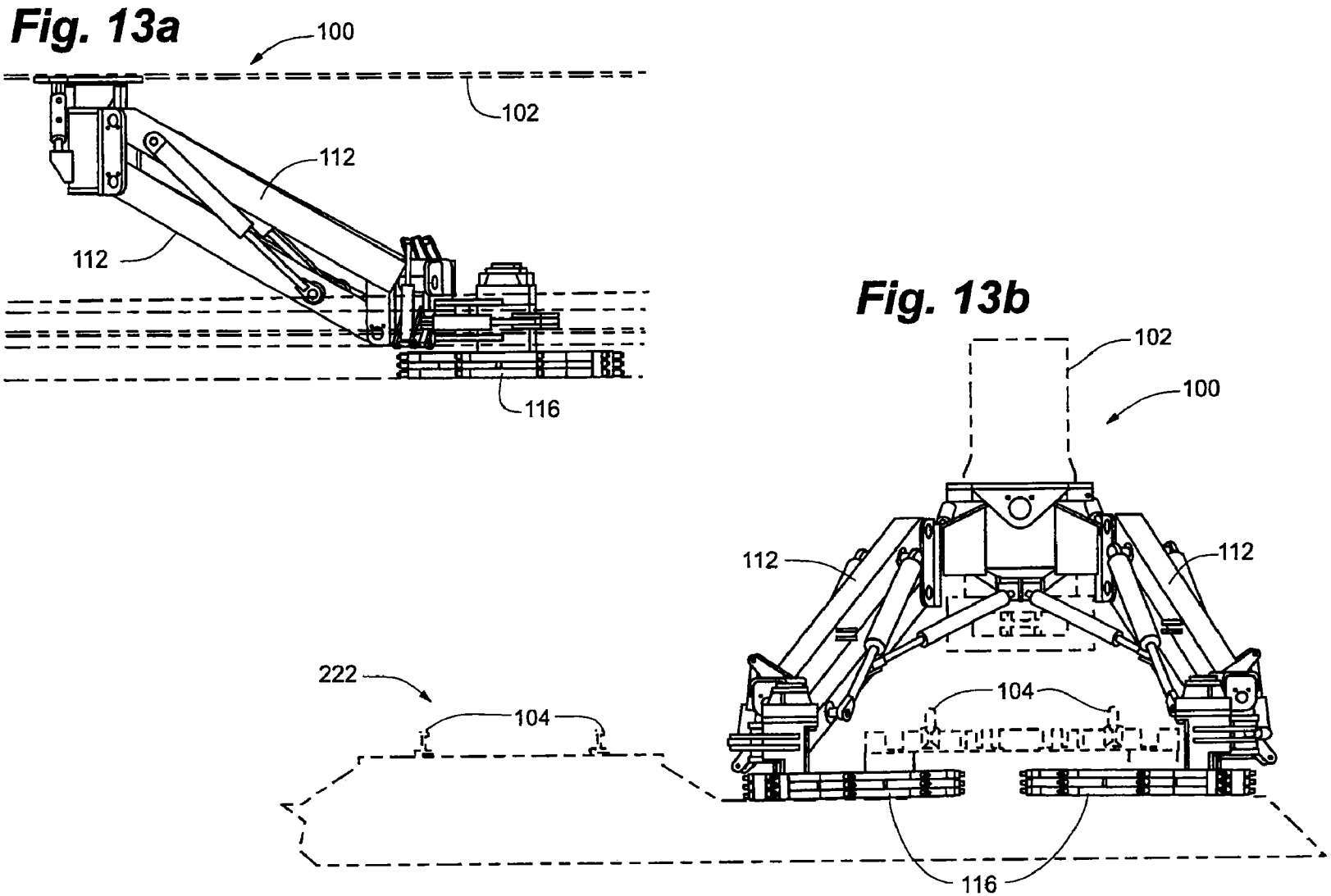
FIG. 13*a* is a side view of the rotary undercutter of FIG. 1 removing ballast on a track with an adjacent rail line.
FIG. 13*b* is a front view of the rotary undercutter of FIG. 13*a*.

FIGS. 13*a* and 13*b* depict an embodiment of a rotary undercutter system 100 where the cutting wheel assemblies 110 are both positioned to remove the ballast 108 under the rail 104 after completion of the cut-in process depicted in FIGS. 12*a* and 12*b*. Likewise, the cutting wheel assemblies 110 can both be removed from underneath the rail 104 with minimal disruption to any parallel track 222.

Figure 14:
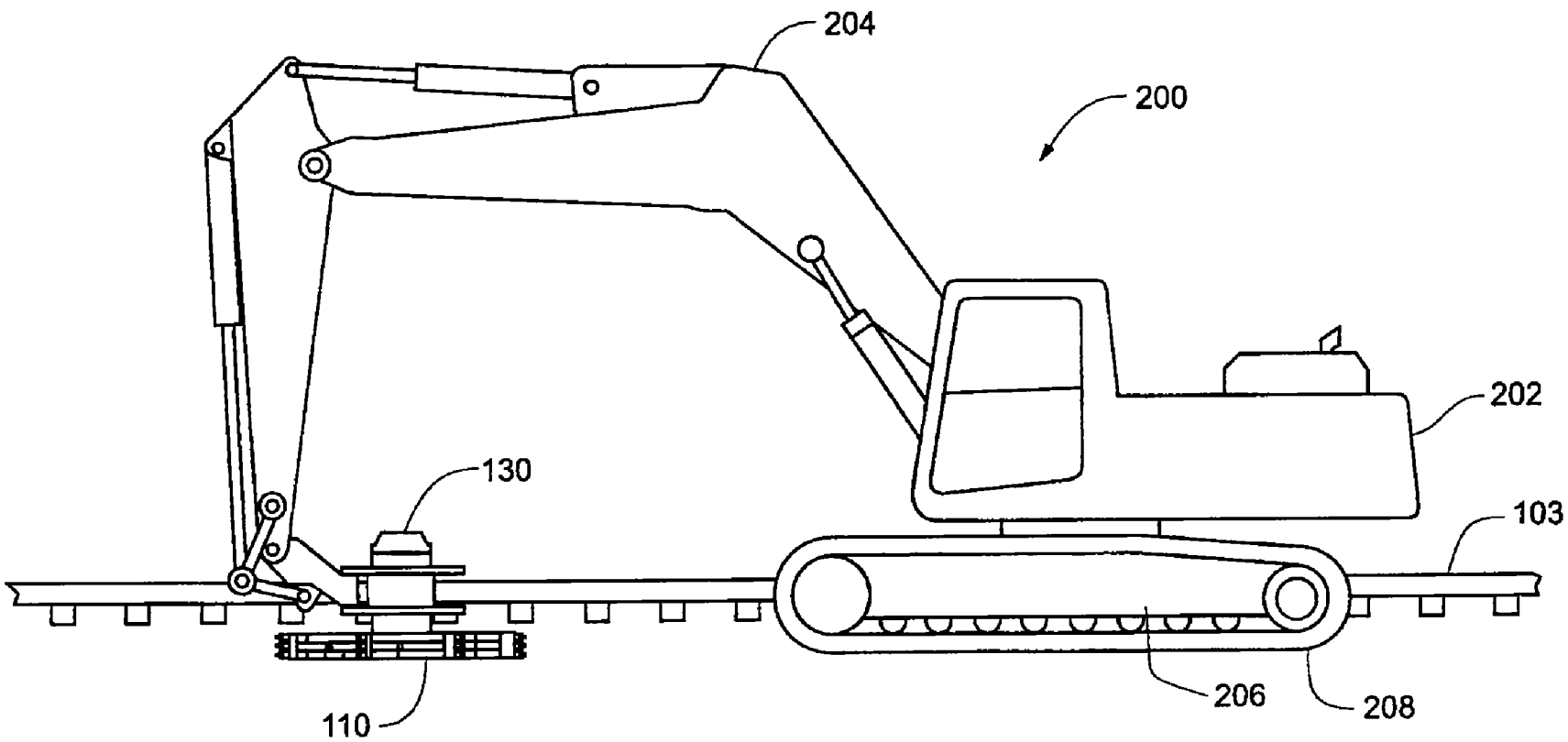
FIG. 14 is a side view of a rotary undercutter operably attached to an engineering vehicle for off-track operation according to an embodiment of the present invention.
Figure 15:
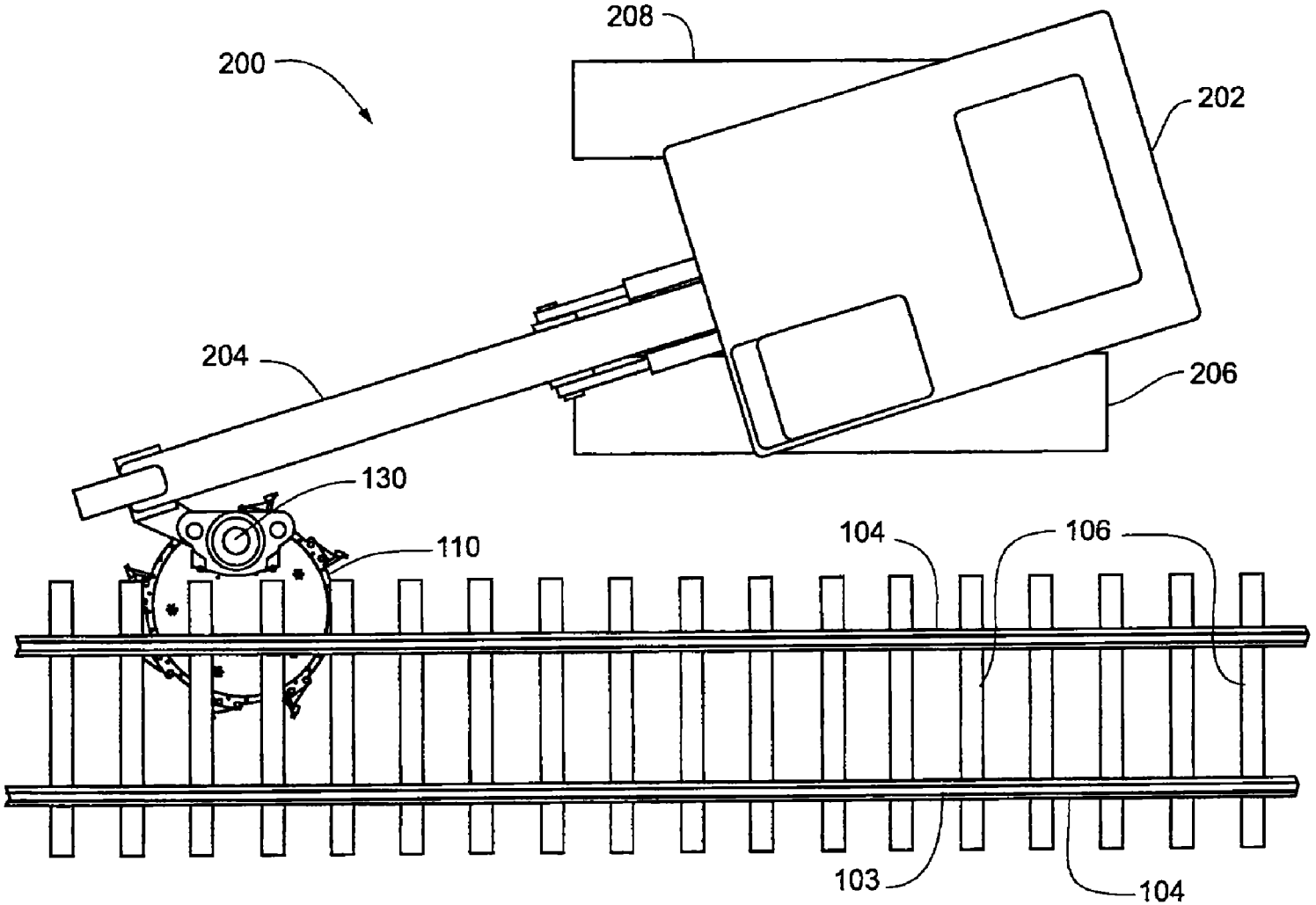
FIG. 15 is a plan view of the rotary undercutter of FIG. 14.

As illustrated in FIGS. 14 and 15, an embodiment of a rotary undercutter 200 can comprise cutting wheel assembly 110 operably coupled to an engineering vehicle such as, for example, an excavator 202 or alternatively, a backhoe or similar implement. Excavator 202 generally comprises an articulated boom 204 that provides the positioning abilities of multi-jointed positioning arm 112. Excavator 202 can comprise an undercarriage 206 having a track assembly 208 or off-track operation, or alternatively, a rail wheel assembly allowing the excavator 202 to move along the rail line 103. Generally, cutting wheel assembly 110 will include drive motor 130 that is powered directly off the engine/generator of excavator 202 or alternatively, a stand-alone generator assembly can be towed or otherwise positioned proximate the excavator 202 so as to supply the necessary power to drive motor 130.

Rotary undercutter 200 can function in a manner similar to rotary undercutter 100 with the exception that one side of the rail line 103 is undercut first whereby the excavator 202 can be subsequently positioned on an opposing side to complete the undercutting work. Rotary undercutter 200 can be used in locations and situations where the use of the track supported rotary undercutter 100 is impractical. Some representative applications for rotary undercutter 200 can include short portions of rail line 103 requiring undercutting work or where the amount of undercutting work does not financially support a track supported rotary undercutter 100. As excavator 202 can utilize a quick-coupler on the articulated boom 204, a variety of attachments besides the rotary undercutter 100 can be used including, for example, buckets, compactors, pulverizers and hammers, thereby increasing the use of excavator 202.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

The foregoing descriptions present numerous specific details that provide a thorough understanding of various embodiments of the invention. It will be apparent to one skilled in the art that various embodiments, having been disclosed herein, may be practiced without some or all of these specific details. In other instances, known components have not been described in detail in order to avoid unnecessarily obscuring the present invention. It is to be understood that even though numerous characteristics and advantages of various embodiments are set forth in the foregoing description, together with details of the structure and function of various embodiments, this disclosure is illustrative only. Other embodiments can be constructed that nevertheless employ the principles and spirit of the present invention. Accordingly, this application is intended to cover any adaptations or variations of the invention. It is manifestly intended that this invention be limited only by the following claims and equivalents thereof.

For purposes of interpreting the claims for the present invention, it is expressly intended that the provisions of Section 112, sixth paragraph of 35 U.S.C. are not to be invoked with respect to a given claim unless the specific terms "means for" or "step for" are recited in that claim.

What is claimed is:

1. A cutting wheel assembly for rail maintenance, comprising:

a rotating cutting wheel having a central drive ring with an internal gear formed on an inner perimeter surface of the central drive ring, the central drive ring mounted between and upper ring and a lower ring with upper and lower disks attached to the upper ring and lower ring to enclose the internal gear, and a plurality of cutting attachments mounted about the perimeter of the rotating cutting wheel, each cutting attachment being individually attached to the rotating cutting wheel.

2. The cutting wheel of claim 1, further comprising a plurality of bogey wheels operably mounted on hubs positioned between the upper disk and the lower disk, said bogey wheels arranged to provide structural rigidity to the rotating cutting wheel.

3. The cutting wheel of claim 1, wherein the upper disk includes a drive opening, and wherein a drive bearing, a drive bushing and a drive gear are positioned between the lower disk and the drive opening, said drive gear operably engaging the internal gear.

4. The cutting wheel of claim 3, wherein a drive column is mounted to the upper disk such that the drive column covers the drive opening.

5. The cutting wheel of claim 4, wherein the drive column encloses a drive shaft operably coupled to the drive gear.

6. The cutting wheel of claim 5, wherein a drive motor is attached to the drive column, said drive motor rotatably engaging the drive shaft.

7. The cutting wheel of claim 4, wherein the drive column includes a mounting bracket and an actuation bracket.

8. The cutting wheel of claim 7, wherein a supporting arm is coupled to the mounting bracket and the actuation bracket, said supporting arm attached to a railcar supporting structure.

9. The cutting wheel of claim 7, wherein an articulated boom is coupled to the mounting bracket and the actuation bracket, said articulated boom attached to an engineering vehicle.

10. The cutting wheel of claim 7, wherein the mounting bracket comprises a reversible mounting bracket.

* * * * *

UNITED STATES PATENT AND TRADEMARK OFFICE

CERTIFICATE OF CORRECTION

PATENT NO. : 7,987,620 B2
APPLICATION NO. : 12/961113
DATED : August 2, 2011
INVENTOR(S) : Huebner et al.

It is certified that error appears in the above-identified patent and that said Letters Patent is hereby corrected as shown below:

Column 2, Line 14:
Delete "or cutting".

Column 4, Line 14:
Delete "multi jointed" and insert -- multi-jointed --.

Column 6, Line 26:
Delete the second occurrence of "positioning".

Column 9, Line 15:
After "between" delete "and" and insert -- an --.

Signed and Sealed this
Twenty-seventh Day of December, 2011

David J. Kappos

David J. Kappos
*Director of the United States Patent and Trademark Office*